United States Patent [19]

Jones et al.

[11] 3,971,288

[45] July 27, 1976

[54] MOUTHPIECE EXTRACTOR

[76] Inventors: Robert C. Jones, R.D. 6, Box 275; Robert W. Anderson, R.D. 6, Forest View Acres, both of Flemington, N.J. 08822

[22] Filed: Dec. 8, 1975

[21] Appl. No.: 638,319

[52] U.S. Cl. ..... 84/453
[51] Int. Cl.[2] ..... G10D 9/02
[58] Field of Search ..... 84/398, 399, 453

[56] References Cited

UNITED STATES PATENTS

| | | | |
|---|---|---|---|
| 2,253,411 | 8/1941 | Thompson | 84/453 X |
| 3,191,483 | 6/1965 | Williams | 84/398 |
| 3,677,129 | 7/1972 | Lyon | 84/453 |

*Primary Examiner*—Lawrence R. Franklin
*Attorney, Agent, or Firm*—Jesse Woldman

[57] ABSTRACT

Apparatus for safely extracting a mouthpiece which has become jammed or locked into the tubular stem of a musical instrument comprises an adjustable, coaxially aligned assembly including a mouthpiece-engaging slotted ring member externally threaded for engagement with the internally threaded portion of a slotted support collar to which is adjustably coupled a clamping means having a central opening for abutting an enlargement on the tubular stem of the instrument wherein upon rotation of the ring member within the support collar in one direction, the length of the apparatus is increased causing a thrust on the mouthpiece away from the tubular extension of the instrument to free the mouthpiece therefrom.

11 Claims, 11 Drawing Figures

FIG. 1
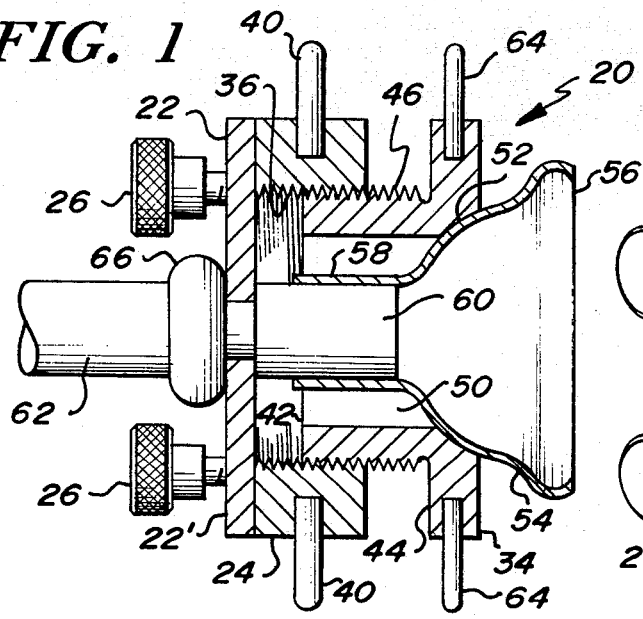
FIG. 2
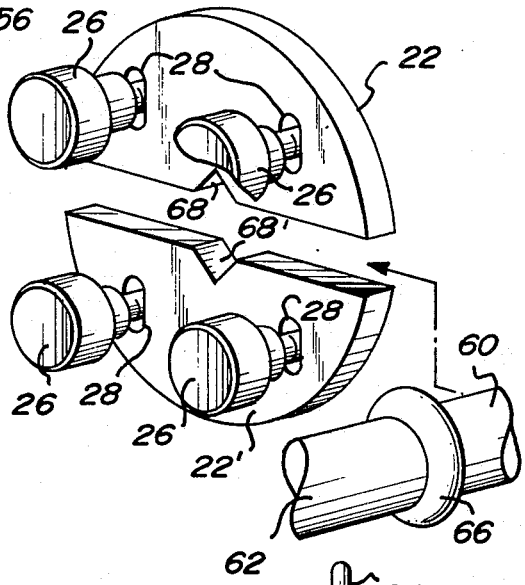
FIG. 3
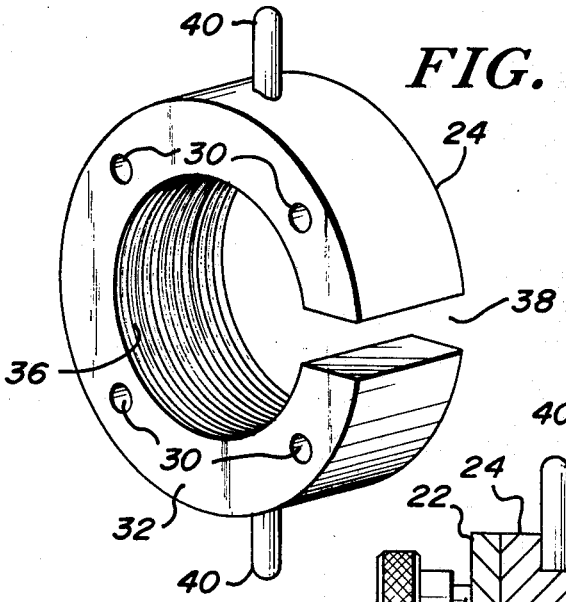
FIG. 4
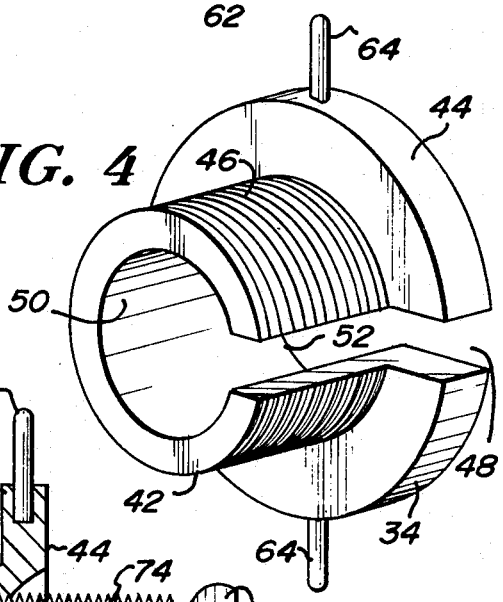
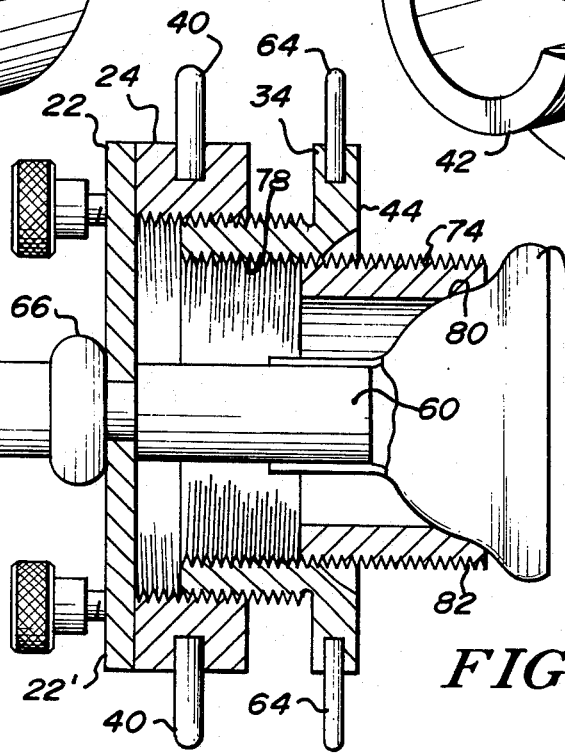
FIG. 5

MOUTHPIECE EXTRACTOR

BACKGROUND OF THE INVENTION

1. Field of the Invention

The invention is directed to the field of extracting devices and in particular to a mouthpiece extracting apparatus.

2. Description of the Prior Art

U.S. Pat. No. 2,253,411 issued to J. Thompson, and U.S. Pat. No. 3,677,129 issued to Lyons are exemplary of the relatively narrow range of prior art devices designed to extract a mouthpiece from the stem of a brass wind instrument. The former device, although relatively simple in construction, requires careful alignment and manipulation to avoid damaging the mouthpiece and stem, while the latter device lacks the precision of movement and uniformity of thrust necessary in such application. The problem is further complicated by the fact that most brass wind instruments are constructed from relatively thin tubular stock which may be easily deformed or bent if subjected to relatively small twisting or bending forces. Accordingly, any force which is applied to the mouthpiece and instrument stem to separate these parts after they have been jammed or locked together must be applied smoothly, uniformly, an linearly along a true coaxial path to prevent further damage or injury to the instrument.

SUMMARY OF THE INVENTION

The invention overcomes the difficulties and limitations noted above with respect to prior art devices by providing a mouthpiece extractor which is more reliable, efficient, and more safely employed than such prior art devices. The apparatus of the instant invention comprises, in one embodiment, a pair of notched, adjustable clamping plates coupled to an internally threaded support collar. Threaded into the support collar is an externally threaded hollow ring member having a preferably tapered or beveled opening at its free end for abutting the rear surface of the enlarged end of the mouthpiece. The collar and ring member are radially slotted to permit the members to be placed over the tubular stem of the instrument adjacent the mouthpiece. The clamping plates are locked in position adjacent the enlargement on the stem of the instrument and the ring member adjusted so that its free end abuts the mouthpiece. Further rotation of the ring member relative to the collar in a suitable direction causes a smooth, uniform, axial thrust to be applied to the mouthpiece in a direction away from the remainder of the instrument to separate the mouthpiece therefrom. The collar and ring may each be provided with grasping means to facilitate adjustment of the device. A hollow tubular extension member suitably configured on its outer surface to cooperate with the interior of the ring member may be provided to increase the adjustable range of the device. It is therefore an object of this invention to provide an improved extraction device.

It is another object of this invention to provide a means for exerting a smooth, uniform, axial thrust on a mouthpiece jammed into the extension of a brass wind instrument to disengage the mouthpiece therefrom.

It is further object of this invention to provide a means for safely and undeformedly removing a mouthpiece from a brass wind instrument.

Other objects and features will be pointed out in the following description and claims and illustrated in the accompanying drawings which disclose, by way of example, the principle of the invention and the best modes contemplated for carrying it out.

BRIEF DESCRIPTION OF THE DRAWINGS

In the Drawings

FIG. 1 is a side elevational view, in section, of an extraction device constructed in accordance with the concepts of the invention.

FIG. 2 is a perspective view of the clamping members of the device of FIG. 1.

FIG. 3 is a perspective view of the support collar of the device of FIG. 1.

FIG. 4 is a perspective view of the ring member of the device of FIG. 1.

FIG. 5 is a side elevational view, in section, of a further embodiment of an extraction device constructed in accordance with the concepts of the invention.

Similar elements are given similar reference characters in each of the respective drawings.

DESCRIPTION OF THE PREFERRED EMBODIMENTS

Figure 11:
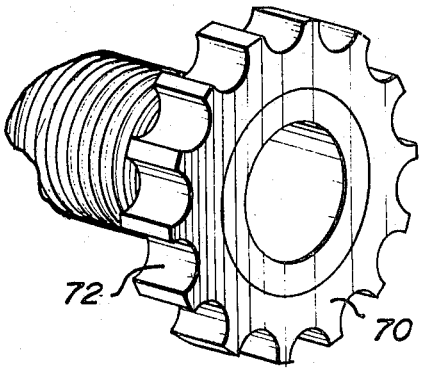
FIG. 11 is a fragmentary perspective view of a further embodiment of a ring member for an extraction device constructed in accordance with the concept of the invention.

Turning now to FIGS. 1, 2, 3, 4, and 6 there is shown a mouthpiece extractor 20 constructed in accordance with the concept of the invention and comprising clamping means shown as an upper clamping plate 22 and a lower clamping plate 22$^1$, a support collar 24, means for coupling the clamping plates 22, 22$^1$ to the support collar 24 comprising four screws 26 each extending through a respective transverse slot 28 in the clamping plates 22, 22$^1$ and threadably engageable with respective threaded holes 30 selectively located at a first end 32 of the collar 24, and a ring member 34 threadably engaged with the collar 24. The support collar 24 has a threaded interior surface 36, and a radially extending opening 38 communicating with the interior surface 36. Spaced about the periphery of the collar 24 are grasping means shown as pins 40. The ring member 34 comprises a hollow tubular elongate element having a first end 42, a second end 44, and an externally threaded portion 46 adjacent its first end 42 and extending towards its second end 44. The externally threaded portion 46 of the ring member 34 is adapted to threadably mate with the threaded interior surface 36 of the collar 24 in the manner shown in FIG. 1 to provide an adjustable coaxially aligned assembly of the two parts. The ring member 34 also includes a radially extending opening 48 similar to the opening 38 in collar 24 and communicating with an interior opening 50 in the ring member 34. The second end 44 of the ring member 34 is provided with a selectively beveled or tapered surface 52 communicating with the interior opening 50 and arranged to abut a rear portion 54 (FIG. 1) of a mouthpiece 56 shown in FIG. 1 as having a tubular extension 58 friction fitted over a stem 60 of a muscial instrument only a portion 62 of which is illustrated in FIG. 1. The ring member 34 is provided with grasping means shown as pins 64 similar to pins 40, the pins 64 being disposed about the periphery of the enlarged second end 44 of the ring member 34. Although the clamping plates 22, 22[1], the support collar 24, and the ring member 34 are all shown as constructed from metallic material, any one or more of these elements may, of course, be conveniently fabricated from any suitable plastic or non-metallic material capable of providing the necessary strength and rigidity. In use, the ring member 34 is threaded into the support collar 24 a suitable distance so that the overall length of the two members is somewhat less than the distance between the mouthpiece 56 and an enlargement 66 on the musical instrument 62 adjacent the stem 60. The radial openings 38 and 48 in the collar 24 and the ring member 34, respectively, are aligned with one another to provide a continuous opening through which the stem 60 and the mouthpiece extension 58 are inserted for positioning within the interior of the extractor 20. The screws 26 are loosened sufficiently so that the clamping plates 22, 22[1] may be separated from one another to receive the stem 60 therebetween, substantially as shown in FIG. 2. The plates 22, 22[1] are each provided with a notched opening 68, 68[1], respectively, arranged to engage the outer periphery of the stem 60 and abut the enlargement 66. The plates 22, 22[1] are then urged together adjacent the enlargement 66 and the screws 26 tightened to maintain the plates 22, 22[1] in firm engagement with the stem 60. The enlargement 66 thus provides a brace or support for the extractor 20 during operation. The ring member 34 is then rotated in a suitable direction to cause it to move axially away from the collar 24 and towards the mouthpiece 56 so that the tapered surface 52 of the ring member 34 abuts the adjacent rear portion of the mouthpiece 56, thereby exerting a substantially uniform axial thrust about the periphery of the rear portion of the mouthpiece in a direction away from the stem 60. The ring member 34 is further rotated in the same direction until the mouthpiece extension 58 is loosened from its functional engagement with the instrument stem 60 thereby completing the extraction operation. The pins 40 and 64 which provide a convenient means for grasping and rotating the respective elements 24 and 34 may be replaced by any other suitable arrangement which will permit the user to exert additional torque on the respective elements. On such arrangement is shown in FIG. 11 wherein a further embodiment of a ring member 70 is shown provided with a scalloped or castellated periphery as at 72 for more firmly grasping the ring member 70. It will, of course, be readily apparent to those skilled in the art, that other selective contour arrangements may be provided to effect a similar purpose, any may include a series of flatted portions arranged to accept the jaws of a wrench or other like torque applying tool. It should be further understood that the respective interfitting threaded portions 36 and 46 on the collar 24 and the ring member 34 may be replaced by any one of a number of other well known drive systems for longitudinally displacing one member with respect to another, which may include a ball and helical groove arrangement (not shown) wherein a spring-loaded ball provided on one member is caused to ride within a helical groove on the other member so that rotation of the members in opposite directions will cause an axial displacement of the members in accordance with the direction of rotation.

Figure 6:
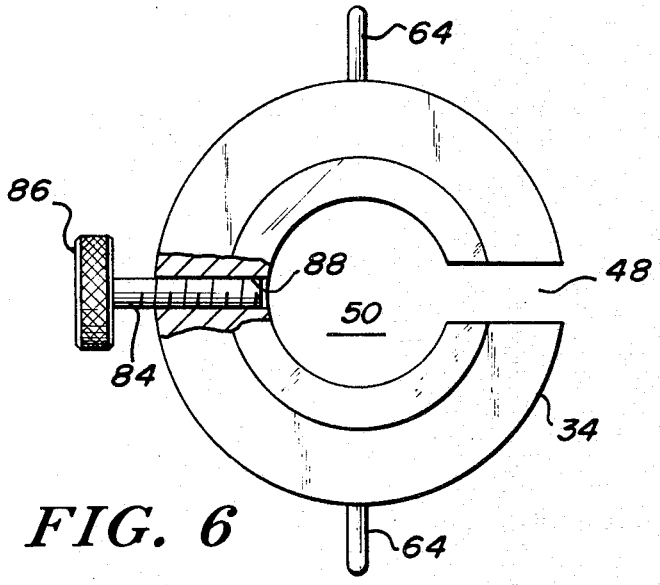
FIG. 6 is a front elevational view, partly cut away and partly in section, of the ring member of the device of FIGS. 1 and 5.

Referring now to FIGS. 5 and 6, the range of adjustment of the extraction device 20 may be readily and conveniently increased by the addition of a hollow tubular extension member 74. Member 74 is provided with a threaded exterior portion 76 arranged to threadably engage a threaded interior portion 78 provided on the ring member 34. The member 74 is further provided with a radially extending opening not visible in the sectional view of FIG. 5 but essentially similar to the openings 38 and 48 in the respective collar and ring member 24 and 34 to provide lateral access to the interior of the extension member 74. The extension member 74 may also be provided with a tapered or beveled surface 80 similar to surface 52 on the ring member 34 adjacent one end 82 for intimate seating against the mouthpiece 56. The extension member 74 is employed by threading it into the free or second end 44 of the ring member 34 a suitable distance to provide an overall length between the clamping plates 22, 22[1] and the end 82 of the extension member 74 sufficient to span the distance between the mouthpiece 56 and the instrument enlargement 66. The ring member 34 is located at some convenient intermediate point within the collar 24 so that both the ring member 34 and the extension member 74 are adequately supported during the final phase of the operation. In the final adjustment, the extension member 74, either independently or in unison with the ring member 34 is rotated sufficiently to cause its second end 82 to abut the mouthpiece 56 in the manner illustrated in FIG. 5. It should, of course, be clear that the extension member 74 is added to the basic extractor assembly 20 where the total deployed length of the ring member 34 and collar 24 is insufficient to traverse the distance between the enlargement 66 and the mouthpiece 56 and exert sufficient thrust on the mouthpiece 56 to accomplish the extraction operation in a particular musical instrument. After the extractor assembly has been adjusted in position substantially as shown in FIG. 5, the ring member 34 and the extension member 74 are locked together so that both will be deployed simultaneously upon suitable rotation of the ring member 34. The locking means shown in the embodiment illustrated in FIG. 6 comprises a screw 84 having an enlarged head portion 86 to facilitate manual rotation thereof. The ring member 34 and extension member 74 are locked together by threading the screw 84 into a radially extending threaded aperture 88 in the ring member 34 until the end of the screw advances beyond the interior surface 50 of the ring member 34 and engages the exterior threaded portion of the extension member 74. The two elements are now locked together and the ring member 34 may then be rotated in a suitable direction to cause the end 82 of the extension member 74 to exert a thrust on the mouthpiece 56 for removal from the instrument stem 60. After the extraction operation, the clamping plates 22 and 22[1] are loosened from engagement with the stem 60 and the entire extractor assembly removed from the musical instrument.

Figure 7:
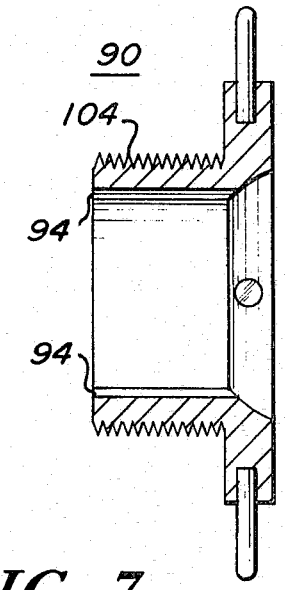
FIG. 7 is a side elevational view, in section, of a further embodiment of a ring member for an extraction device constructed in accordance with the concept of the invention.
Figure 8:
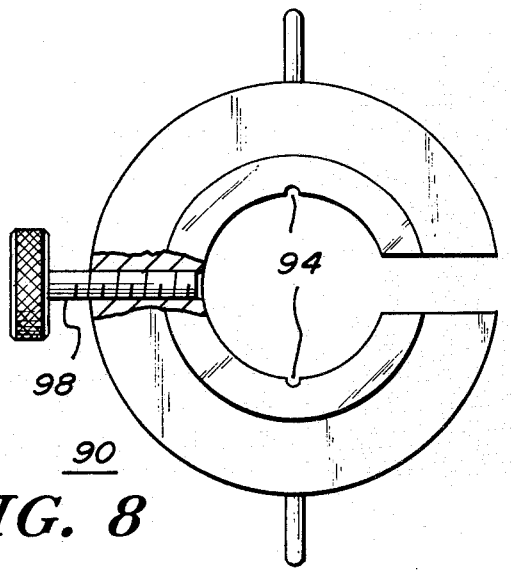
FIG. 8 is a front elevational view, partly cut away and partly in section, of the ring member of FIG. 7.
Figure 9:
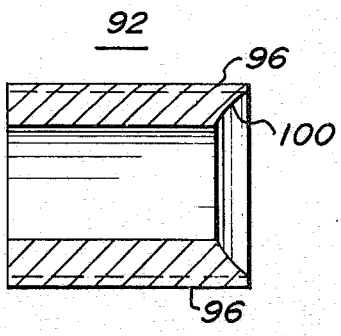
FIG. 9 is a side elevational view, in section, of a further embodiment of an extension member for an extraction device constructed in accordance with the concepts of the invention.
Figure 10:
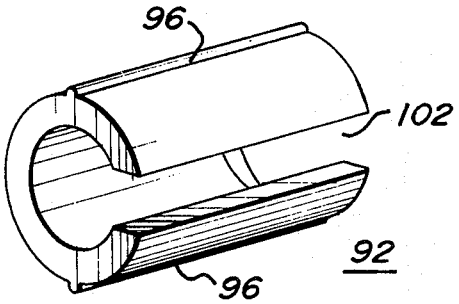
FIG. 10 is a perspective view of the device of FIG. 9.

Referring now to FIGS. 7, 8, 9, and 10 there is shown a further embodiment of a ring member 90 and an extension member 92 constructed in accordance with the concepts of the invention. The ring member 90 shown in FIGS. 7 and 8 is provided with one or more longitudinally extending interior recesses 94 selectively dimensioned to slidingly receive preferably a similar number of longitudinally extending ribs 96 located about the external periphery of the extension member 92. To accomplish the initial adjustment between the two members, the extension member 92 is properly axially oriented with respect to the ring member 90 and inserted thereinto so that the ribs 96 are guided within the recesses 94. When the extension member 92 has been advanced into the ring member 90 the desired distance, the two members are locked together by means of a screw 98 (FIG. 8) similar to element 84 shown in FIG. 6. The ring member 90 is then rotated in the manner described above with respect to the embodiment illustrated in FIG. 5 to complete the extraction operation. As further shown in FIG. 9, the extension member 92 comprises a tapered annular end surface 100 similar to surface 80 of member 74, and a radially extending opening 102 similar to the opening provided in members 74, 34, and 24. It will of course be readily apparent to those skilled in the art that a similar interfitting arrangement between the ring member 90 and the extension member 92 may be accomplished by a splined assembly (not shown) wherein one of the two members is provided with a series of splines and the other member provided with a series of spline receiving recesses resembling, respectively, the ribs 96 and the recesses 94 shown in FIGS. 7 through 10. As further shown in FIG. 7, the ring member 90 is provided with a threaded exterior portion 104 essentially duplicative of the portion 46 of ring member 34 for threaded engagement with the support collar 24.

The embodiments of the invention in which an exclusive property or privilege is claimed are defined as follows:

1. Apparatus for removing the mouthpiece from a musical instrument comprising, in combination: clamping means having a central opening therethrough for engaging the tubular portion of said instrument adjacent an enlargement on the tubular portion; a support collar having an annular threaded interior portion and a radially extending opening communicating with said threaded interior surface of said collar to receive the tubular portion of said instrument therethrough; means for removably coupling said clamping means to said collar; and hollow ring means coaxially aligned with said support collar and having a first end, a second end, an annular threaded exterior portion adjacent said first end, said threaded exterior portion being rotatably engaged with said threaded interior portion of said collar, and a radially extending opening communicating with the interior of said ring means to receive the tubular portion of said instrument therethrough, said ring means second end being adapted to abut said mouthpiece to exert a longitudinal thrust thereon to separate said mouthpiece from the tubular portion of said instrument as said ring means and said support collar are rotated in opposite directions relative to one another so as to cause said ring means to move longitudinally away from said clamping means.

2. Apparatus as defined in claim 1 wherein said clamping means comprises an upper clamping plate and a lower clamping plate.

3. Apparatus as defined in claim 2 wherein each of said clamping plates has transverse slots, and said means for coupling said clamping means to said collar comprises screw means, one for each of said transverse slots, and said collar has threaded openings for receiving said screw means.

4. Apparatus as defined in claim 1 wherein said ring means has a selectively formed annular interior surface adjacent said second end thereof for intimate seating about said mouthpiece.

5. Apparatus as defined in claim 1 further comprising a hollow tubular extension member longitudinally movable within said ring means to increase the adjustable length of said apparatus, said extension member having a radially extending opening communicating with the interior of said extension member to receive the tubular portion of said instrument therethrough, said extension member having a first end arranged to abut said mouthpiece to exert a longitudinal thrust thereon.

6. Apparatus as defined in claim 5 wherein said extension member has a second end opposite said first end, said extension member having a threaded exterior portion adjacent said second end thereof, said ring means having a threaded interior portion rotatably engaged with said threaded exterior portion of said extension member to selectively adjust the overall length of said ring means and said extension member.

7. Apparatus as defined in claim 6 further comprising means cooperative with said ring means and said extension member for releasably locking said ring means to said extension member

8. Apparatus as defined in claim 7 wherein said means for locking comprises screw means threaded radially into said ring means and extendable into the interior thereof for engagement with said extension member.

9. Apparatus as defined in claim 5 wherein said extension member has at least one longitudinally extending rib on its exterior surface, and said ring means has a mating longitudinally extending rib receiving recess within its interior surface for guiding said extension member during adjustment.

10. Apparatus as defined in claim 1 wherein said ring means comprises means located about the external periphery thereof for grasping said ring means.

11. Apparatus as defined in claim 1 wherein said support collar comprises means located about the external periphery thereof for grasping said support collar.

* * * * *